US011359843B2

(12) United States Patent
Nezuka et al.

(10) Patent No.: US 11,359,843 B2
(45) Date of Patent: Jun. 14, 2022

(54) REFRIGERATION SYSTEM AND METHOD FOR CONTROLLING THE SAME

(71) Applicants: KABUSHIKI KAISHA TOSHIBA, Minato-ku (JP); Toshiba Energy Systems & Solutions Corporation, Kawasaki (JP)

(72) Inventors: Hayato Nezuka, Yokohama (JP); Shohei Takami, Yokohama (JP); Tomofumi Orikasa, Yokohama (JP)

(73) Assignees: KABUSHIKI KAISHA TOSHIBA, Minato-ku (JP); Toshiba Energy Systems & Solutions Corporation, Kawasaki (JP)

( * ) Notice: Subject to any disclaimer, the term of this patent is extended or adjusted under 35 U.S.C. 154(b) by 175 days.

(21) Appl. No.: 15/906,697

(22) Filed: Feb. 27, 2018

(65) Prior Publication Data

US 2018/0216853 A1 Aug. 2, 2018

Related U.S. Application Data

(63) Continuation of application No. PCT/JP2016/077092, filed on Sep. 14, 2016.

(30) Foreign Application Priority Data

Sep. 15, 2015 (JP) ..... JP2015-182122

(51) Int. Cl.
*F25B 9/14* (2006.01)
*F25B 9/06* (2006.01)
(Continued)

(52) U.S. Cl.
CPC ..... *F25B 9/14* (2013.01); *F25B 9/06* (2013.01); *F25B 31/02* (2013.01); *F25B 49/02* (2013.01);
(Continued)

(58) Field of Classification Search
CPC ..... F04B 37/06; F04B 37/08; F04B 37/085; F25B 9/14; F25B 9/06; F25B 31/02;
(Continued)

(56) References Cited

U.S. PATENT DOCUMENTS

2011/0126554 A1 6/2011 Morris et al.
2013/0133341 A1* 5/2013 Viargues ..... F25B 9/00 62/6

FOREIGN PATENT DOCUMENTS

JP 1-210765 8/1989
JP 2-29557 1/1990
(Continued)

OTHER PUBLICATIONS

International Search Report dated Dec. 13, 2016 In PCT/JP2016/077092, filed on Sep. 14, 2016 (with English Translation).
(Continued)

*Primary Examiner* — John F Pettitt, III
(74) *Attorney, Agent, or Firm* — Oblon, McClelland, Maier & Neustadt, L.L.P.

(57) ABSTRACT

According to one embodiment, there is provided a refrigeration system including detectors, each of which detects a phase indicative of a displacement of a displacer of each of cryogenic refrigerators; a processor that calculates an operation frequency of a motor of each of the cryogenic refrigerators, which is a frequency that suppresses oscillations or noises generated by reciprocating motions of the displacer of each of the cryogenic refrigerators, based on a detection result obtained by each of the detectors; and drivers, each of which drives the motor of each of the cryogenic refrigerators based on a calculation result obtained by the processor.

3 Claims, 4 Drawing Sheets

(51) Int. Cl.
*F25B 49/02* (2006.01)
*F25B 31/02* (2006.01)

(52) U.S. Cl.
CPC ..... *F25B 2400/06* (2013.01); *F25B 2500/12* (2013.01); *F25B 2500/18* (2013.01); *F25B 2500/19* (2013.01)

(58) Field of Classification Search
CPC .. F25B 49/02; F25B 2400/06; F25B 2500/12; F25B 2500/19
USPC ..... 62/55.5, 6
See application file for complete search history.

(56) References Cited

FOREIGN PATENT DOCUMENTS

| | | |
|---|---|---|
| JP | 2-213655 | 8/1990 |
| JP | 6-159835 | 6/1994 |
| JP | 2000-199653 | 7/2000 |
| JP | 2004-20029 | 1/2004 |
| JP | 2004-317048 | 11/2004 |
| JP | 2011-521201 | 7/2011 |
| WO | WO 2013/168206 A1 | 11/2013 |

OTHER PUBLICATIONS

Written Opinion dated Dec. 13, 2016 in PCT/JP2016/077092, filed on Sep. 14, 2016.

* cited by examiner

REFRIGERATION SYSTEM AND METHOD FOR CONTROLLING THE SAME

CROSS-REFERENCE TO RELATED APPLICATIONS

This application is a Continuation Application of PCT Application No. PCT/JP2016/077092, filed Sep. 14, 2016 and based upon and claiming the benefit of priority from Japanese Patent Application No. 2015-182122, filed Sep. 15, 2015, the entire contents of all of which are incorporated herein by reference.

FIELD

Embodiments described herein relate generally to a refrigeration system and a method for controlling the same.

BACKGROUND

A cryogenic refrigerator can cool, for example, a superconductive magnet. The cryogenic refrigerator is adopted to a refrigeration system. The refrigeration system is adapted for health-care equipment, such as an MRI (Magnetic Resonance Imaging) apparatus, or a heavy particle beam radiotherapy apparatus to treat cancer. When the cryogenic refrigerator is operated, oscillations and noises are generated, which burden the patient and impair precision equipment.

Another example of the cryogenic refrigerator is a low-oscillation cryogenic refrigerator, such as a pulse tube refrigerator. However, the low-oscillation cryogenic refrigerator is inferior in reliability and performance to a conventional cryogenic refrigerator using a displacer, for example, a GM (Gifford McMahon) refrigerator.

Therefore, when a high-reliability and high-performance conventional refrigerator, namely, a refrigerator using a displacer is operated, there is a demand that oscillations and noises generated from the refrigerator should be reduced.

The cryogenic refrigerator using the displacer adiabatically expands a refrigerant gas (working fluid), such as helium gas, compressed by a compressor by periodic reciprocation (upward and downward motions) of the displacer in a cylinder, and exchanges heat between the refrigerant gas and a cool storage device in the displacer, thereby cooling a cooling end. Furthermore, there is a known technique of measuring a temperature of the cooling end, and controlling a plurality of refrigerators to operate by a calculation controller, so that the measured temperature can be maintained at a target cooling temperature.

When refrigerators are operated while their cooling ends are thermally connected to one another, if peak timings of oscillations or noises coincide due to the reciprocations of the displacer in the cryogenic refrigerators, the oscillations and noises generated from a target to be cooled will be significant.

DETAILED DESCRIPTION

In general, according to one embodiment, there is provided a refrigeration system including cryogenic refrigerators, each of which comprises a motor, a cylinder, and a displacer provided in the cylinder, and generates a refrigerant atmosphere by expanding a refrigerant gas supplied to an expansion space in the cylinder in accordance with reciprocating motions of the displacer inside the cylinder by driving of the motor; detectors, each of which detects a phase indicative of a displacement of the displacer of each of the cryogenic refrigerators; a processor that calculates an operation frequency of the motor of each of the cryogenic refrigerators, which is a frequency that suppresses oscillations or noises generated by the reciprocating motions of the displacer of each of the cryogenic refrigerators, based on a detection result obtained by each of the detectors; and drivers, each of which drives the motor of each of the cryogenic refrigerators based on a calculation result obtained by the processor.

Hereinafter, embodiments will be described with reference to the drawings.

First Embodiment

The first embodiment will be described.

(Configuration)

Figure 1:
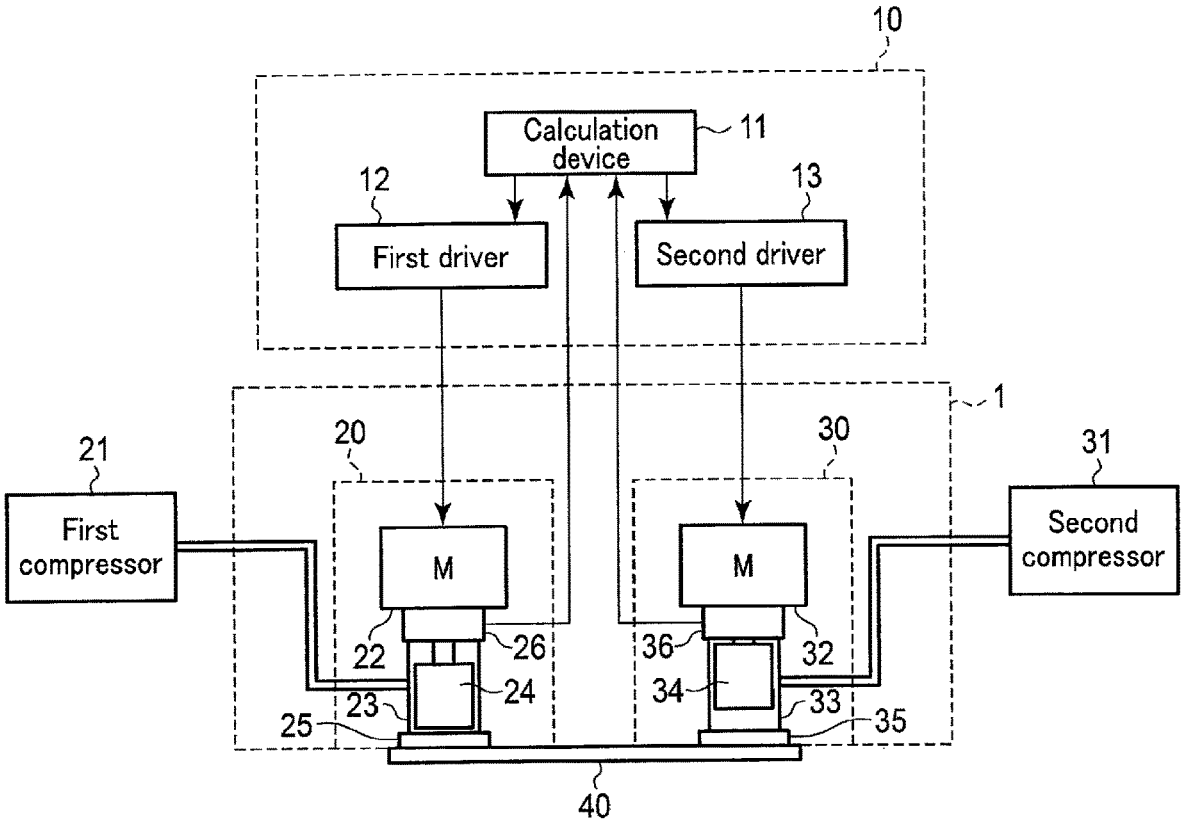
FIG. 1 is a diagram showing a configuration example of a refrigeration system according to a first embodiment.

FIG. 1 is a diagram showing a configuration example of a refrigeration system according to the first embodiment.

The refrigeration system of the first embodiment includes a cryogenic refrigerator 1 and a controller 10. The cryogenic refrigerator 1 includes a first GM refrigerator 20 and a second GM refrigerator 30.

The first GM refrigerator 20 is connected to a first compressor 21 which compresses a refrigerant gas. The second GM refrigerator 30 is connected to a second compressor 31 which compresses a refrigerant gas.

The controller 10 includes a calculation device 11, a first driver 12, and a second driver 13. The calculation device 11 can be realized by a device implemented as a computer device, such as a personal computer (PC). For example, the computer device includes a processor, such as a central processing unit (CPU), and a volatile memory, a non-volatile memory, a communication interface, etc., which are connected to the processor. The calculation device 11 achieves various processing by means of the processor executing programs stored in the non-volatile memory. The first GM refrigerator 20 includes a motor 22, a cylinder 23, a displacer 24, a first cooling end 25, and a first displacer phase measuring device 26. Similarly, the second GM refrigerator 30 includes a motor 32, a cylinder 33, a displacer 34, a second cooling end 35, and a second displacer phase measuring device 36.

The first displacer phase measuring device 26 is a detector that continuously detects a phase indicative of a displacement of the displacer 24 by, for example, laser measurement.

Similarly, the second displacer phase measuring device 36 is a detector that continuously detects a phase indicative of a displacement of the displacer 34 by, for example, laser measurement.

When an intake valve (not shown) provided in a flow path of the refrigerant gas between the first compressor 21 and the first GM refrigerator 20 opens, the refrigerant gas compressed by the first compressor 21 flows into the cylinder 23 in the first GM refrigerator 20. Similarly, when an intake valve (not shown) provided in a flow path of the refrigerant gas between the second compressor 31 and the second GM refrigerator 30 opens, the refrigerant gas compressed by the second compressor 31 flows into the cylinder 33 in the second GM refrigerator 30.

The first GM refrigerator 20 has a configuration in which the displacer 24 performs reciprocating motions along an axial direction of the cylinder 23 inside the cylinder 23 by driving of the motor 22. An expansion space is present between the cylinder 23 and the displacer 24. The high-pressure refrigerant gas supplied to the expansion space is expanded by the reciprocating motions of the displacer 24 inside the cylinder 23 as described above. A cryogenic refrigerant atmosphere is generated by the expansion. Similarly, the second GM refrigerator 30 has a configuration in which the displacer 34 performs reciprocating motions along an axial direction of the cylinder 33 inside the cylinder 33 by driving of the motor 32. An expansion space is present between the cylinder 33 and the displacer 34. The high-pressure refrigerant gas supplied to the expansion space is expanded by the reciprocating motions of the displacer 34 inside the cylinder 33 as described above. A cryogenic refrigerant atmosphere is generated by the expansion.

This embodiment is a case in which a GM refrigerator is used as the refrigerator. However, the embodiment is not limited to this case; various cryogenic refrigerator devices (for example, a solvay refrigerator, a stirling refrigerator, etc.) can be applied.

A cooling end 40, which thermally connects a first cooling end 25 of the first GM refrigerator 20 and a second cooling end 35 of the second GM refrigerator 30, is provided between the first cooling end 25 and the second cooling end 35.

(Operation)

Figure 2:
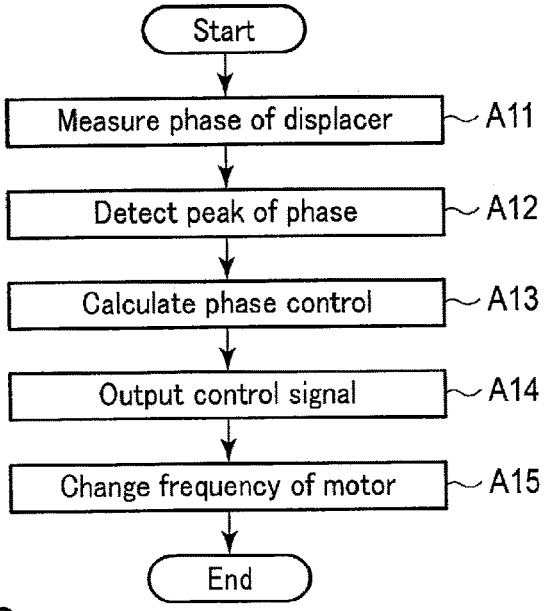
FIG. 2 is a flowchart showing an example of an operation sequence by the refrigeration system according to the first embodiment.

Next, the operation of the refrigeration system of the first embodiment will be described. FIG. 2 is a flowchart showing an example of an operation sequence by the refrigeration system according to the first embodiment. Operations of the first GM refrigerator 20 are the same as those of the second GM refrigerator 30. Operations of the first compressor 21 are the same as those of the second compressor 31. Therefore, the operations of the first GM refrigerator 20 and the first compressor 21 are described in detail, whereas the operations of the second GM refrigerator 30 and the second compressor 31 are described in brief.

First, the first GM refrigerator 20 and the second GM refrigerator 30 of the cryogenic refrigerator 1 are activated. The calculation device 11 in the controller 10 reads a displacer phase signal indicative of a displacement of the displacer 24 from the first displacer phase measuring device 26. The calculation device 11 reads a displacer phase signal indicative of a displacement of the displacer 34 from the second displacer phase measuring device 36 (A11).

The calculation device 11 incorporates an A/D converter (not shown). The calculation device 11 converts the displacer phase signal into digital data by means of the A/D converter. The calculation device 11 stores, after performing a calibration, the digital data as phase data of reciprocating motions of the displacers 24 and 34 in a storage device (not shown) in the calculation device 11.

Based on the phase data of the reciprocating motions of the displacer 24 of the first GM refrigerator 20 and the phase data of the reciprocating motions of the displacer 34 of the second GM refrigerator 30, the calculation device 11 detects peak timings of phases of oscillations or noises generated by the reciprocating motions of the displacers 24 and 34 (A12).

Of all frequencies of phase-measured signals, a frequency indicative of oscillations or a frequency indicative of noises is assumed to be determined in advance by an experiment, simulation, or the like. The calculation device 11 detects a peak timing of a phase at the frequency indicative of the oscillations, or a peak timing of a phase at the frequency indicative of the noises.

The calculation device 11 performs calculations for a phase control described below under a first condition or a second condition (A13). The first condition is that the detected peak timing of the phase of the oscillations, generated by the reciprocating motions of the displacer 24 of the first GM refrigerator 20, does not coincide with the detected peak timing of the phase of the oscillations, generated by the reciprocating motions of the displacer 34 of the second GM refrigerator 30. The second condition is that the peak timing of the phase of the noises, generated by the reciprocating motions of the displacer 24 of the first GM refrigerator 20, does not coincide with the peak timing of the phase of the noises, generated by the reciprocating motions of the displacer 34 of the second GM refrigerator 30.

The phase control is executed in real time based on PID (Proportional-Integral Derivative) control according to a classical control theory or based on a modern control theory.

Figure 3:
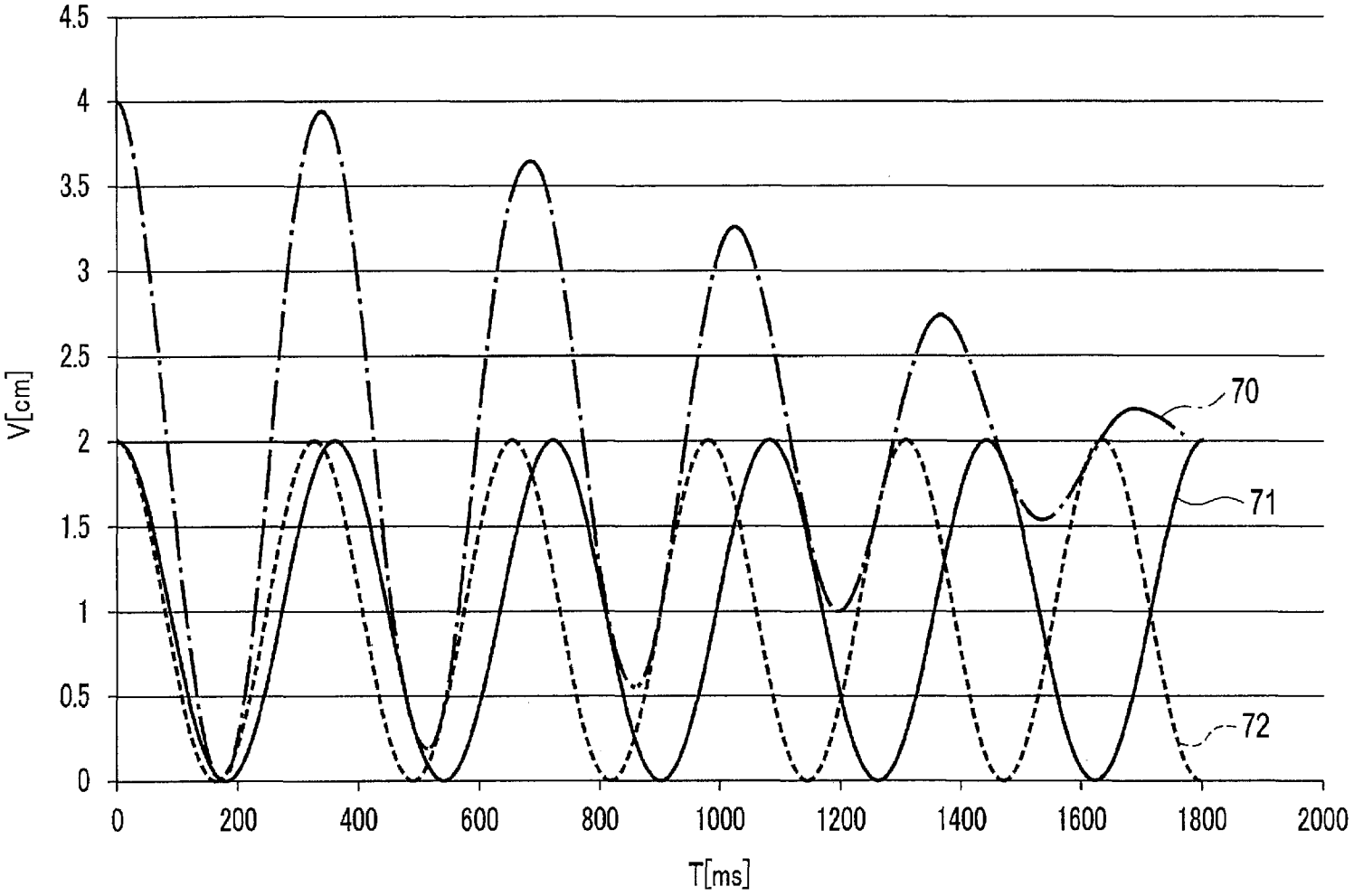
FIG. 3 is a diagram for explaining a phase control by a calculation device of the refrigeration system according to the first embodiment.

FIG. 3 is a diagram for explaining a phase control by the calculation device of the refrigeration system according to the first embodiment. In the graph shown in FIG. 3, the horizontal axis represents time T, and the vertical axis represents an oscillation level V. The vertical axis may represent a noise level.

As shown in FIG. 3, at time 0, when a peak timing of an oscillation phase 71 of the displacer 24 of the first GM refrigerator 20 coincides with a peak timing of an oscillation phase 72 of the displacer 34 of the second GM refrigerator 30, the value of an oscillation phase 70 composed of these oscillation phases 71 and 72 is larger in comparison with a case in which the timings do not coincide. In contrast, when the peak timing of the oscillation phase 71 does not coincide with the peak timing of the oscillation phase 72, the value of the oscillation phase 70 composed of these oscillation phases 71 and 72 is smaller in comparison with the case in which timing values coincide.

The calculation device 11 calculates a new operation frequency of the motor 22 of the first GM refrigerator 20 and a new operation frequency of the motor 32 of the second GM refrigerator 30 for a phase control that shifts the detected peak timing of the oscillation phase 71 from the detected peak timing of the oscillation phase 72, preferably for a phase control that makes the peak value of the composite oscillation phase 70 smaller than a target value.

Under the condition that the operation frequency of the motor of either one of the first GM refrigerator 20 and the second GM refrigerator 30, for example, the motor 22 of the first GM refrigerator 20, is fixed, the calculation device 11 may calculate a new operation frequency of the motor 32 of the second GM refrigerator 30 for a phase control.

Thus, the calculation device 11 performs a calculation for a phase control to make the peak of the composite oscillation phase 70 small by shifting the peak timings of the oscillation phases 71 and 72 from each other.

Furthermore, as shown in FIG. 3, when the oscillation phases 71 and 72 are opposite, the peak of the composite oscillation phase 70 is the smallest. Therefore, the calculation device 11 may perform a calculation for a phase control to make the oscillation phases 71 and 72 opposite.

The calculation device 11 outputs a control signal based on a result of the calculation described above to the first driver 12 and the second driver 13 (A14).

Each of the first driver 12 and the second driver 13 is a driver that includes a single-phase inverter. The single-phase inverter as a power converter, including a plurality of semiconductor switching elements, is connected to a DC power source. The first driver 12 converts the control signal from the calculation device 11 to a single-phase AC voltage command value, indicative of a desired frequency and amplitude, by means of the DC power source and the semiconductor switching elements, and supplies the single-phase AC voltage command value to the motor 22 of the first GM refrigerator 20. Similarly, the second driver 13 converts the control signal from the calculation device to a single-phase AC voltage command value indicative of a desired frequency and amplitude, and supplies the single-phase AC voltage command value to the motor 32 of the second GM refrigerator 30.

The first driver 12 changes the operation frequency of the motor 22 of the first GM refrigerator 20 in accordance with the single-phase AC voltage command value, based on the calculation result from the calculation device 11. Similarly, the second driver 13 changes the operation frequency of the motor 32 of the second GM refrigerator 30 in accordance with the single-phase AC voltage command value, based on the calculation result from the calculation device 11 (A15).

As described above, the oscillations or noises generated by reciprocating motions of the displacer in the cryogenic refrigerator 1 are suppressed by controlling the operation frequencies of the motors of the respective refrigerators.

If the number of GM refrigerators in the cryogenic refrigerator 1 is three or more, the oscillations or noises can be suppressed by performing similar controls for the GM refrigerators.

Advantageous Effects

As described above, the refrigeration system of the first embodiment controls the frequency of each of the GM refrigerators to shift the peak timings of oscillations or noises of the GM refrigerators from each other, based on the measurement result of the phases indicative of oscillations or noises that are generated by the reciprocating motions of the displacer of each GM refrigerator. The control can reduce the oscillations or noises in each GM refrigerator.

Second Embodiment

Next, the second embodiment will be described.

(Configuration)

Figure 4:
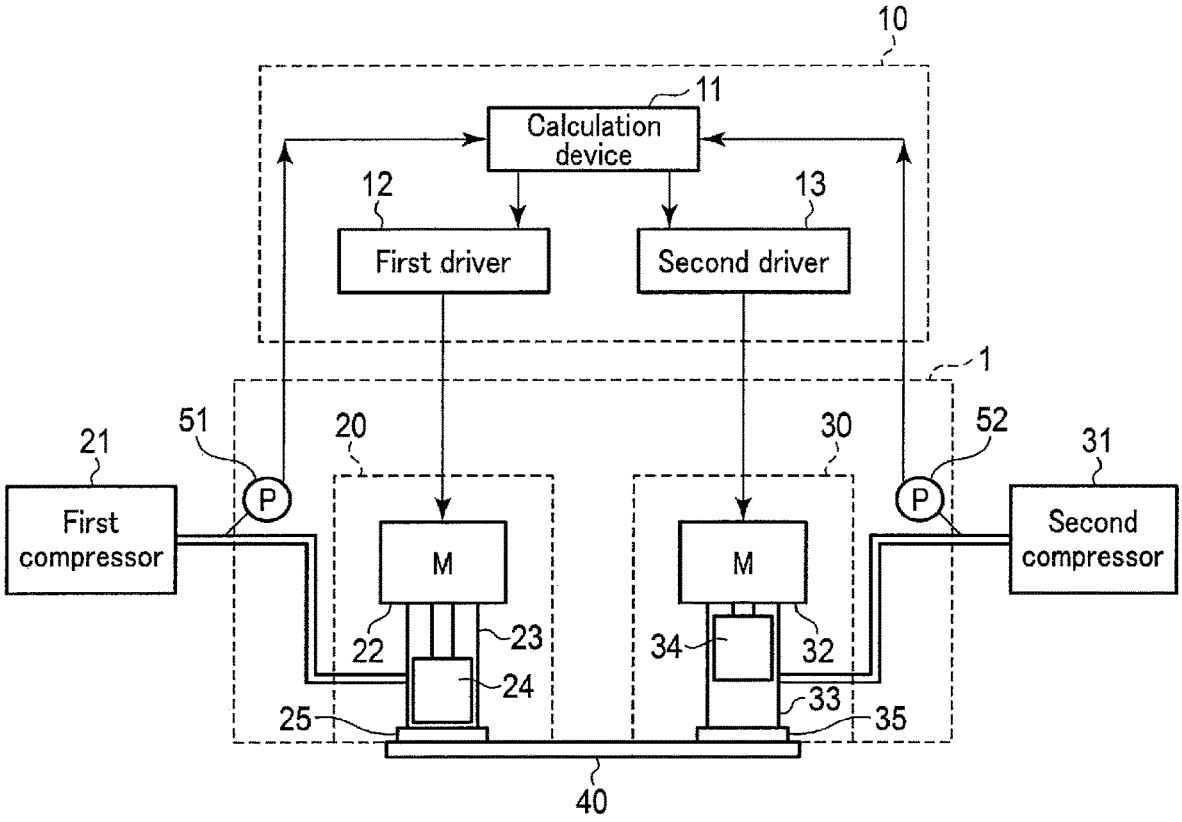
FIG. 4 is a diagram showing a configuration example of a refrigeration system according to a second embodiment.

FIG. 4 is a diagram showing a configuration example of a refrigeration system according to the second embodiment.

The refrigeration system of the second embodiment does not include the first displacer phase measuring device 26 and the second displacer phase measuring device 36 of the first embodiment described above. On the other hand, the refrigeration system of the second embodiment includes a first pressure measuring device 51 and a second pressure measuring device 52. The first pressure measuring device. 51 is provided between a first GM refrigerator 20 and a first compressor 21. The second pressure measuring device 52 is provided between a second GM refrigerator 30 and a second compressor 31.

The first pressure measuring device 51 is a detector that measures a change in operation pressure of the first GM refrigerator 20, that is, a change in pressure due to a change in interval of opening a valve for the refrigerant gas in the flow path between the first compressor 21 and the first GM refrigerator 20, and outputs a measurement result to the calculation device 11.

The second pressure measuring device 52 is a detector that measures a change in operation pressure of the second GM refrigerator 30, that is, a change in pressure due to a change in interval of opening a valve for the refrigerant gas in the flow path between the second compressor 31 and the second GM refrigerator 30, and outputs a measurement result to the calculation device 11.

(Operation)

Figure 5:
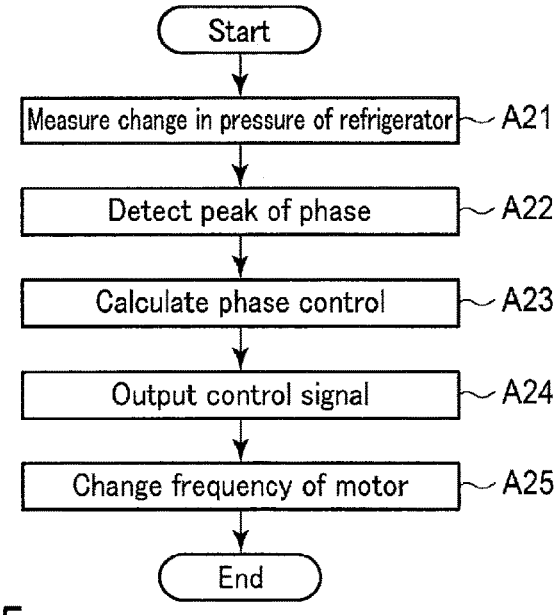
FIG. 5 is a flowchart showing an example of an operation sequence by the refrigeration system according to the second embodiment.

Next, the operation of the refrigeration system of the second embodiment will be described. FIG. 5 is a flowchart showing an example of an operation sequence by the refrigeration system according to the second embodiment.

As described above, the first pressure measuring device 51 measures a change in operation pressure of the first GM refrigerator 20, and outputs the measurement result to the calculation device 11. The second pressure measuring device 52 measures a change in operation pressure of the second GM refrigerator 30, and outputs the measurement result to the calculation device 11 (A21).

Based on the result of measurement of a change in operation pressure of the first GM refrigerator 20 from the first pressure measuring device 51 and the result of measurement of a change in operation pressure of the second GM refrigerator 30 from the second pressure measuring device 52, the calculation device 11 calculates a phase of oscillations or noises generated by reciprocating motions of the displacer of each GM refrigerator, and detects a peak timing of the calculated phases of the oscillations or noises (A22).

In the same manner as in the first embodiment, the calculation device 11 calculates a new operation frequency of the motor 22 of the first GM refrigerator 20 and a new operation frequency of the motor 32 of the second GM refrigerator 30 for a phase control that shifts the peak timing of the oscillation phase 71 of the displacer 24 of the first GM refrigerator 20 from the peak timing of the oscillation phase 72 of the displacer 34 of the second GM refrigerator 30. The subsequent operations are the same as those of the first embodiment (A23, A24, and A25).

If the number of GM refrigerators in the cryogenic refrigerator 1 is three or more, the oscillations or noises can be suppressed by performing similar controls for the GM refrigerators.

Advantageous Effects

As described above, based on the result of measurement of a change in operation pressure of the first GM refrigerator 20 from the first pressure measuring device 51 and the result of measurement of a change in operation pressure of the second GM refrigerator 30 from the second pressure measuring device 52, the refrigeration system of the second embodiment detects a peak timing of the phases of the oscillations or noises generated by reciprocating motions of the displacer of each GM refrigerator. The refrigeration system controls the operation frequencies of the motors of the respective GM refrigerators by shifting the peak timings of the phases of oscillations or noises of the GM refrigerators from each other. Accordingly, the oscillations or noises of each GM refrigerator can be reduced.

Third Embodiment

Next, the third embodiment will be described.

(Configuration)

Figure 6:
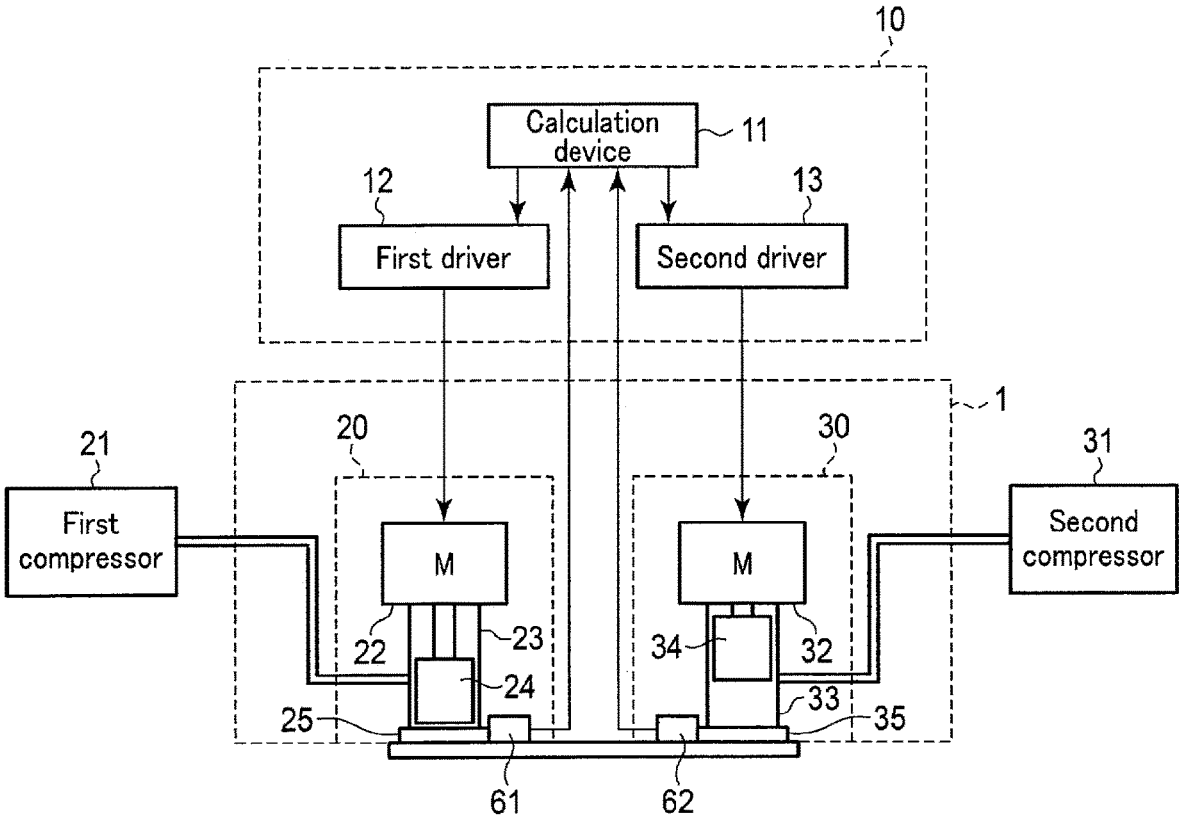
FIG. 6 is a diagram showing a configuration example of a refrigeration system according to a third embodiment.

FIG. 6 is a diagram showing a configuration example of a refrigeration system according to the third embodiment.

The refrigeration system of the third embodiment does not include the first displacer phase measuring device 26 and the second displacer phase measuring device 36 of the first embodiment described above. On the other hand, the refrigeration system of the third embodiment includes a first oscillation measuring device 61 at a first cooling end 25 and a second oscillation measuring device 62 at a second cooling end 35.

The first oscillation measuring device 61 is a detector that measures a change in oscillation of a first GM refrigerator 20 itself, and outputs a measurement result to a calculation device 11. The second oscillation measuring device 62 is a detector that measures a change in oscillation of a second GM refrigerator 30 itself, and outputs a measurement result to the calculation device 11.

(Operation)

Figure 7:
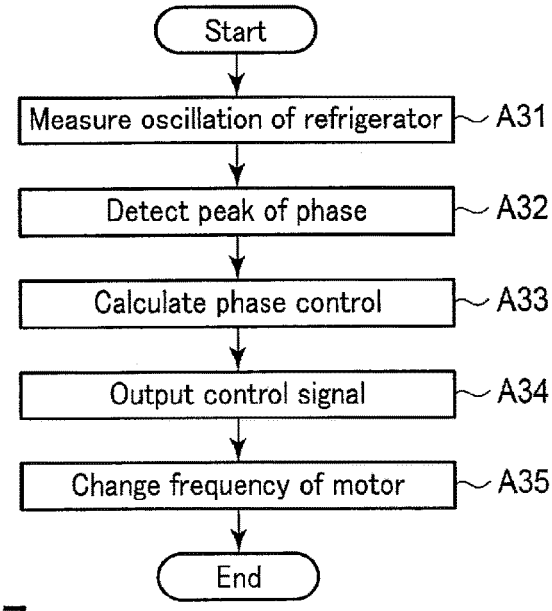
FIG. 7 is a flowchart showing an example of an operation sequence by the refrigeration system according to the third embodiment.

Next, the operation of the refrigeration system of the third embodiment will be described. FIG. 7 is a flowchart showing an example of an operation sequence by the refrigeration system according to the third embodiment.

As described above, the first oscillation measuring device 61 measures a change in oscillation of the first GM refrigerator 20 itself, and outputs the measurement result to the calculation device 11. The second oscillation measuring device 62 measures a change in oscillation of the second GM refrigerator 30 itself, and outputs the measurement result to the calculation device 11 (A31).

Based on the result of measurement of a change in oscillation of the first GM refrigerator 20 from the first pressure measuring device 61 and the result of measurement of a change in oscillation of the second GM refrigerator 30 from the second pressure measuring device 62, the calculation device 11 calculates a phase of oscillations or noises generated by reciprocating motions of the displacer of each GM refrigerator, and detects a peak timing of the calculated phases (A32).

In the same manner as in the first embodiment, the calculation device 11 calculates a new operation frequency of the motor 22 of the first GM refrigerator 20, and a new operation frequency of the motor 32 of the second GM refrigerator 30 for a phase control that shifts the peak timing of the oscillation phase 71 of the displacer 24 of the first GM refrigerator 20 from the peak timing of the oscillation phase 72 of the displacer 34 of the second GM refrigerator 30. The subsequent operations are the same as those of the first embodiment (A33, A34, and A35).

If the number of GM refrigerators in the cryogenic refrigerator 1 is three or more, the oscillations or noises can be suppressed by performing similar controls for the GM refrigerators.

Advantageous Effects

As described above, based on the result of measurement of a change in oscillation of the first GM refrigerator 20 from the first oscillation measuring device 61 and the result of measurement of a change in oscillation of the second GM refrigerator 30 from the second oscillation measuring device 62, the refrigeration system of the third embodiment detects a peak timing of the oscillations or noises generated by reciprocating motions of the displacer of each GM refrigerator. The refrigeration system controls the operation frequencies of the motors of the respective GM refrigerators by shifting the peak timings of the phases of oscillations or noises of the GM refrigerators from each other. Accordingly, the oscillations or noises of each GM refrigerator can be reduced.

While several embodiments have been described, these embodiments have been presented by way of example only, and are not intended to limit the scope of the invention. Indeed, the novel embodiments described herein may be embodied in a variety of other forms; furthermore, various omissions, substitutions, and changes in the form of the embodiments described herein may be made without departing from the spirit of the invention. The accompanying claims and their equivalents are intended to cover such forms or modifications as would fall within the scope and spirit of the inventions.

The procedure implemented by the calculation device 11 of each embodiment can be stored, as a program (software means) which causes a computer to execute the processing, in a storage medium such as a magnetic disk (a floppy (registered trademark) disk, a hard disk, etc.), an optical disk (a CD-ROM, a DVD, an MO, etc.), or a semiconductor memory (a ROM, a RAM, a flash memory, etc.), or can be distributed via communication media. The program stored in the medium includes a setting program, which causes a computer to configure, in the computer, software means to be executed by the computer (including a table and data structure as well as an execution program). The computer which implements the system reads the program stored in the storage medium, configures the software means by the setting program where applicable, and executes the processing described above by control of operations by the software means. The storage medium referred to in this specification is not limited to a storage medium to be used for distribution but includes a storage medium, such as a magnetic disk or a semiconductor memory, provided in the computer or a device connected to the computer via a network.

The invention claimed is:

1. A refrigeration system, comprising:

a plurality of cryogenic refrigerators, each of which comprises a motor, a cylinder, and a displacer provided in the cylinder, and generates a refrigerant atmosphere by expanding a refrigerant gas supplied to an expansion space in the cylinder in accordance with reciprocating motions of the displacer inside the cylinder by driving of the motor;

a plurality of detectors, each of which detects an operation pressure of a corresponding cryogenic refrigerator of the cryogenic refrigerators;

a processor that calculates, for each detector and corresponding cryogenic refrigerator, corresponding signal data representing either oscillations or noises currently generated by the reciprocating motions of the displacer of the corresponding cryogenic refrigerator, based on the operation pressure detected by the corresponding detector, wherein, for each corresponding cryogenic refrigerator, the processor detects peak timings of phases of the corresponding signal data, and calculates a new respective operation frequency of the motor of the corresponding cryogenic refrigerator based on the detected peak timings of the phases of the corresponding signal data, the new operation frequencies suppressing the currently generated oscillations or noises generated by the reciprocating motions, by controlling the peak timings of the phases of the corresponding signal data representing the oscillations or noises, so as not to coincide; and a plurality of drivers, each of which drives the motor of each of the cryogenic refrigerators based on a calculation result obtained by the processor.

2. The refrigeration system of claim 1, wherein the plurality of cryogenic refrigerators consists of two cryogenic refrigerators.

3. A method for controlling a refrigeration system comprising a plurality of cryogenic refrigerators, each of which comprises a motor, a cylinder, and a displacer provided in the cylinder, and generates a refrigerant atmosphere by expanding a refrigerant gas supplied to an expansion space in the cylinder in accordance with reciprocating motions of the displacer inside the cylinder by driving of the motor, the method comprising:

detecting, for each corresponding cryogenic refrigerator, an operation pressure of the corresponding cryogenic refrigerator;

calculating, for each corresponding, cryogenic refrigerator corresponding signal data representing either oscillations or noises currently generated by the reciprocating motions of the displacer of the corresponding cryogenic refrigerator, based on the detected operation pressure of the corresponding cryogenic refrigerator;

detecting, for each corresponding cryogenic refrigerator, peak timings of phases of the corresponding signal data, and calculating a new respective operation frequency of the motor of the corresponding cryogenic refrigerator based on the detected peak timings of the phases of the corresponding signal data, the new operation frequencies suppressing the currently generated oscillations or noises generated by the reciprocating motions, by controlling the peak timings of the phases of the corresponding signal data, representing the oscillations or noises, so as not to coincide; and driving the motor of each of the cryogenic refrigerators based on a calculation result obtained by the calculating.

* * * * *